US005742565A

United States Patent [19]

Cuinet et al.

[11] Patent Number: 5,742,565

[45] Date of Patent: Apr. 21, 1998

[54] CROWN SETTING DEVICE FOR A TIMEPIECE

[75] Inventors: Jean Louis Cuinet, Chevigney sur L'Ognon, France; Michel Plancon, Watertown, Conn.; Yves Vuillame, Beurre, France; Chan Kwong Fung, Kowloon, Hong Kong

[73] Assignee: Timex Corporation, Middlebury, Conn.

[21] Appl. No.: 651,015

[22] Filed: May 21, 1996

[51] Int. Cl.[6] ..... G04B 27/02

[52] U.S. Cl. ..... 368/190; 368/319

[58] Field of Search ..... 368/190, 294–296

[56] References Cited

U.S. PATENT DOCUMENTS

| | | | |
|---|---|---|---|
| 2,547,140 | 4/1951 | Schmitz | 368/190 |
| 4,253,177 | 2/1981 | Hafner | 368/187 |
| 5,083,300 | 1/1992 | Schwartz | 368/185 |
| 5,305,291 | 4/1994 | Kamens et al. | 368/252 |

FOREIGN PATENT DOCUMENTS

| | | | |
|---|---|---|---|
| 343293 | 1/1960 | Switzerland | 368/190 |
| 559927 | 3/1975 | Switzerland | 368/190 |

*Primary Examiner*—Bernard Roskoski
*Attorney, Agent, or Firm*—William C. Crutcher

[57] ABSTRACT

Crown setting device for an alarm setting crown and/or a time setting crown in an analog wristwatch uses a rotatable top ring mounted on the watch case, having gear teeth on its underside which mesh with gear teeth on the crown(s) to rotate the crown(s). This serves to set the time and/or alarms with less time and effort than conventional crown setting. Preferably involute gear teeth are used, but a simple version employs the conventional crown knurling as "teeth".

17 Claims, 3 Drawing Sheets

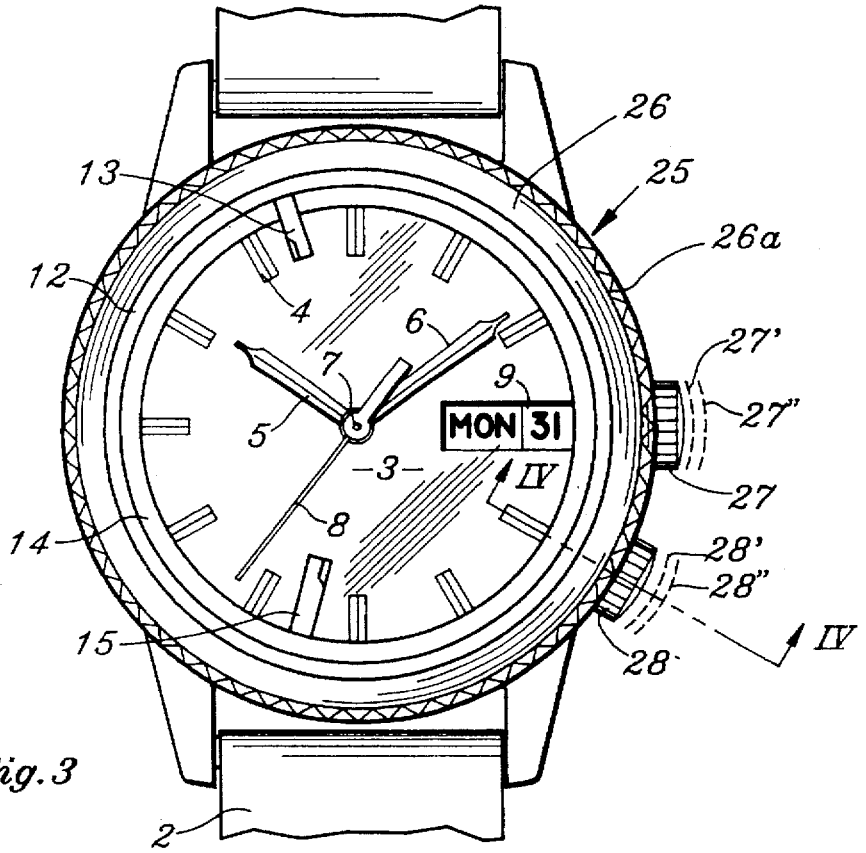
Fig. 3
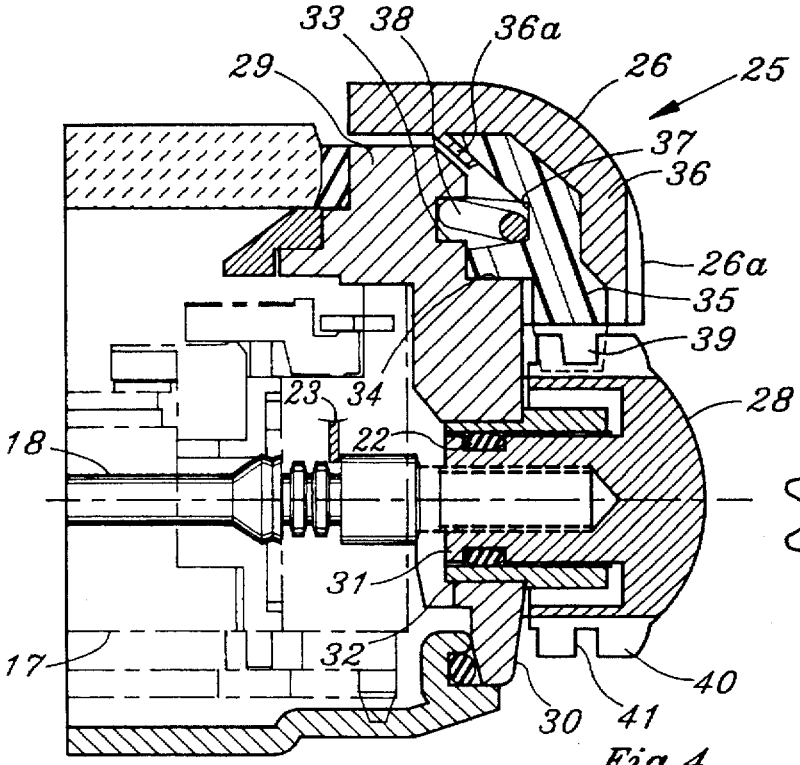
Fig. 4
Fig. 5

CROWN SETTING DEVICE FOR A TIMEPIECE

BACKGROUND OF THE INVENTION

This invention relates generally to timepieces, especially analog wristwatches, and more particularly to an improved crown setting device for rotating the wristwatch hands to set the time or to set an alarm.

Crown setting devices for wristwatches are well known in the art. Usually, an analog wristwatch movement, whether it be mechanical or a quartz analog type powered by an energy cell, has a separate internal set of gears connected between the hands and a special setting gear for rotating the wristwatch hands to perform a setting function. The setting function, as is well known in the art, is generally carried out by manually operating a watch "crown" which protrudes from the side of the watch case. The crown is connected to an axially slidable, rotatable setting stem having a pinion on its inner end which engages the special setting gear when the crown is pulled out. The crown is knurled or corrugated with grooves to provide gripping teeth to assist in turning the crown. This can become a tedious process when the watch hands must be rotated through several revolutions and is also hard on the fingers when the crown is small in diameter.

Simple time-setting crowns having only two axial positions have evolved and been improved, wherein more than one crown may be used, one to set the time and another to set an alarm time. Also the setting crowns may be provided with more than two axial positions by the use of multiple detents, so as to engage a second internal set of gears to set calendar and/or day/date rings as well as the time of day.

FIGS. 1 and 2 of the drawing are top plan view and side elevation view in cross section along II—II, respectively, of a prior art timepiece.

FIG. 1 of the drawing illustrates a timepiece, here a quartz analog wristwatch, having a watch case 1, portions of a strap 2 for attachment to the wrist, and dial 3 with time indicating indicia such as "sticks" 4. The timepiece has an internal conventional quartz analog movement including a stepping motor, gear train and pulse generating IC on a printed circuit (PC) board and is powered by an energy cell. The movement serves to drive an hour hand 5 and minute hand 6 in a 12:1 ratio about a central axis 7. Also shown are a second hand 8 and a day-date indicating window 9. A conventional manually operated time setting crown 10 has three detent positions, the second and third positions indicated in dotted line by reference numerals 10' and 10" respectively. The second position 10' is used to set the date and the third position 10" is used to set the time. The extent of axial movement is exaggerated for purpose of explanation.

A manually actuated alarm setting and actuating crown 11 is arranged at a convenient location on the case 1 such as the four o'clock position. Crown 11 similarly has three detent positions, the second and third of which are shown in dotted lines by reference numerals 11 and 11". Crown 11 serves to operate the alarm setting mechanism. Coaxially disposed about the central axis 7 are two alarm setting rings. The outer ring comprises a minute setting ring 12, which has a minute alarm marker 13 attached thereto. The inner ring comprises an hour setting ring 14 gear-coupled to ring 12 in a 12:1 ratio, and which includes an hour alarm marker 15 attached thereto. Crown 11 is also attached to a rotatable and axially slidable stem, which is engaged in its inner position with settable gear means so as to turn minute setting ring 12 and hour setting ring 14. The stem, when withdrawn, is disengaged mechanically, but is then arranged to engage electrical switch contacts in positions 11' and 11". Details of a time setting mechanism may be seen by reference to U.S. Pat. No. 5,083,300 issued Jan. 21, 1992 to Herbert Schwartz. Details of an alarm setting mechanism may be seen by reference to U.S. Pat. No. 5,305,291 issued Apr. 19, 1994 to Kamens et al. Both of the aforesaid patents are assigned to the present assignee and are incorporated herein by reference.

The prior art cross section of FIG. 2 illustrates a watch case shown generally at 16 with internal movement 17 and a setting stem 18 extending through a sidewall 19 of the case by means of a pendant 20. A crown 21 is connected to stem 18 by screw threads or interference fit. The assembly of stem 18 and crown 21 is rotatable and axially slidable within pendant 20 and sealed against moisture by an O-ring 22. A spring 23 detents the setting stem 18 in two or more axial positions. Simple "teeth" 24 are commonly provided on the crown periphery to assist in turning the crown 21. See FIG. 9 as an example of the corrugations or knurling on a conventional crown.

As previously indicated, rotation of crown 21 through many revolutions to set either the time or the alarm rings of the watch of FIG. 1 can be tiresome and hard on the fingers.

Accordingly, one object of the present invention is to provide an improved crown setting device for an analog timepiece, which is useful for setting either the time or an alarm.

Another object of the invention is to reduce the time and discomfort required to rotate watch hands through many revolutions.

Another object of the present invention is to provide an improved crown setting device which is simple to operate and reliable and economical to manufacture.

SUMMARY OF THE INVENTION

Briefly stated, the invention comprises an improved crown setting device for an analog timepiece having a case with a sidewall, a movement having settable gear means disposed inside the case, a setting stem rotatably mounted in the case sidewall in a first axial position, the setting stem being axially slidable to engage the sortable gear means to perform a setting function when the setting stem is rotated in a second axial position. The improved device comprises a crown connected to the setting stem and having surface portions accessible outside of the case for enabling manual actuation in either an axial direction between the first and second positions, a top ring rotatably mounted on the case and adapted to be manually rotated, first means including a first set of teeth disposed on the underside of the top ring, and second means including a second set of teeth disposed on the crown, the second set of teeth meshing with the first set of teeth in both the first and second axial positions. The invention is especially useful for setting the alarm and/or timer in a quartz analog calendar alarm watch, and may be used with more than one setting crown.

DRAWING

The invention, both as to organization and method of practice, together with further objects and advantages thereof, will best be understood by reference to the following description, taken in connection with the accompanying drawings, in which:

FIG. 1 is a top plan view of a prior art quartz analog calendar wristwatch with both time setting and alarm setting crowns, FIG. 2 is a side elevational view in cross section of a prior art crown setting device, taken along lines II—II of FIG. 1.

FIG. 3 is a top plan view of a quartz analog wristwatch according to the present invention, FIG. 4 is a side elevational view in cross section, taken along lines IV—IV of FIG. 3, FIG. 5 is an end elevational view of the crown shown in FIG. 4, FIG. 6 is a side elevational view in cross section of a modification of the invention, FIG. 7 is an end elevational view of a gear member used in FIG. 6, FIG. 8 is a further modification showing a simplified form of the invention, and FIG. 9 is an end elevational view of the crown shown in FIG. 8.

DESCRIPTION OF THE PREFERRED EMBODIMENT

Figure 1:
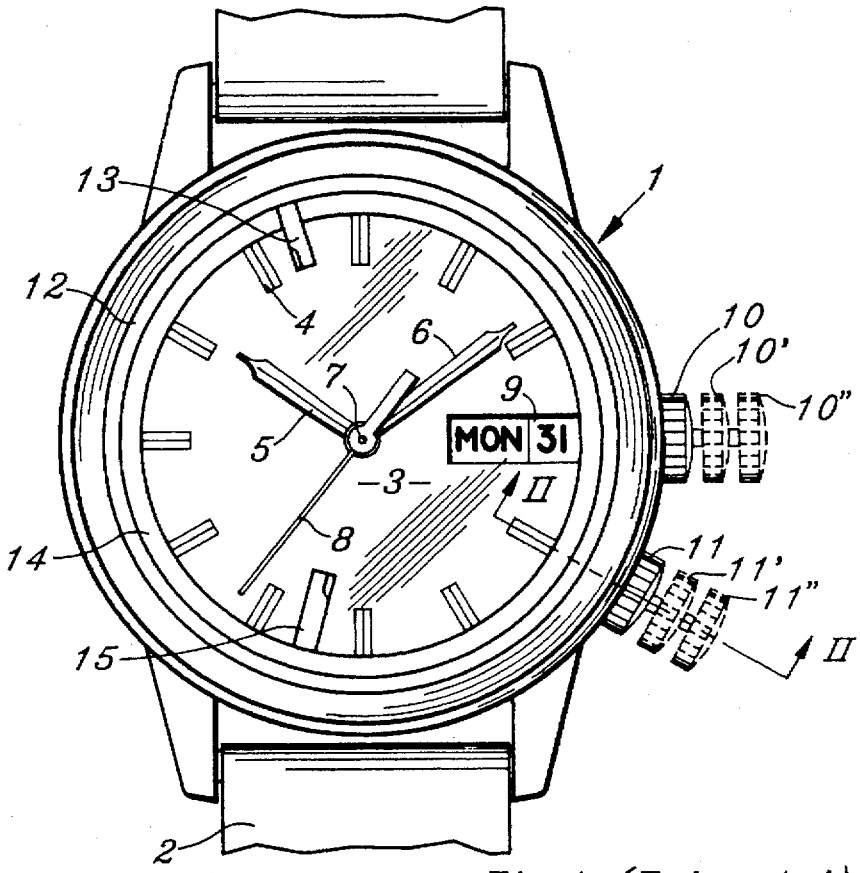
Fig.1 (Prior Art)
Figure 2:
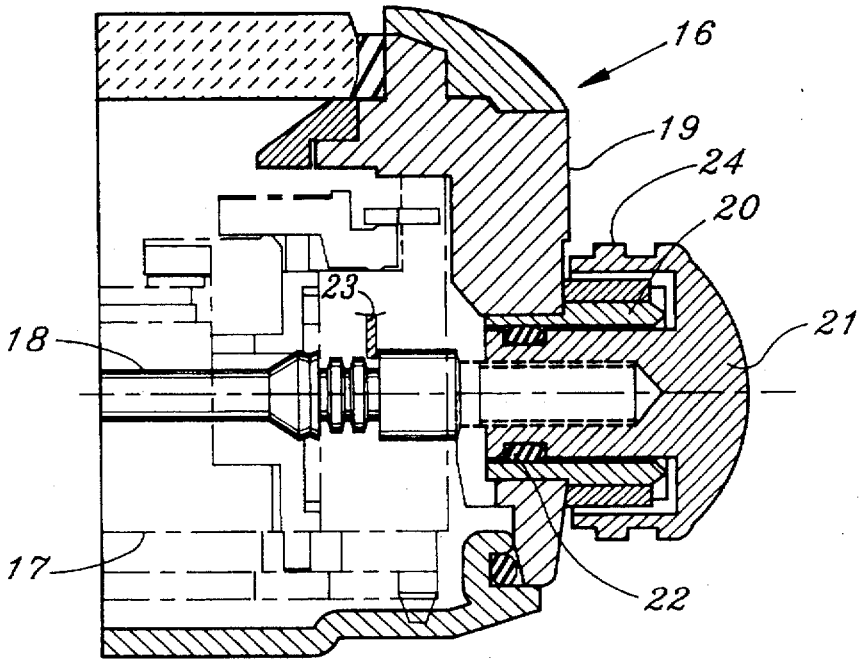
Fig.2 (Prior Art)

Referring to FIGS. 3, 4 and 5 of the drawing, a preferred form of the invention is illustrated for a quartz analog day/date calendar wristwatch 25 with alarm setting functions similar to the watch previously described in connection with FIG. 1. The description of elements having reference numerals 2–9 and 12–15 is as previously described. However, rather than having a stationary decorative top ring as shown in FIGS. 1 and 2, the wristwatch 25 of FIG. 3 is provided with a rotatable top ring 26, which is adapted to be rotated by means of knurling or roughened surface shown by reference numeral 26*a*. A time setting crown 27 is located at the three o'clock position and an alarm setting crown 28 is located at the four o'clock position. Time setting crown 27 may be moved axially to two other detented axial positions indicated by reference numerals 27' and 27" and shown in dashed lines. Similarly, the alarm setting crown 28 may be moved axially to two other detented axial positions indicated by reference numerals 28' and 28" and shown in dashed lines.

Referring to FIG. 4, the wristwatch 25 includes a case 29 with a sidewall 30. Contained in case 29 are the previously described movement 17, setting stem 18, and detent spring 23 which operate in a manner as previously described in the prior art. Crown 28 includes a shank 31 which is slidably and rotatably mounted in a pendant 32 passing through the sidewall 30. O-ring 22 provides a seal as before. Shank 31 of crown 28 is connected to the end of shank stem 18 by screw threads or force fit.

While not illustrated in the drawing, the internal mechanism is constructed in a similar manner as described in U.S. Pat. No. 5,305,291, incorporated herein by reference, to operate the internal stem member 18, which may be detented in three axial positions so as to engage and actuate electrical switches in positions 28', 28", as well as to engage and rotate a sortable gear train inside the watch case in its inner position to rotate the alarm setting rings 12, 14 so as to set the alarm time or a timer. The stem is disengaged from the settable gear train in positions 28', 28".

In accordance with the present invention, the top ring 26 is rotatably mounted on the case 29. Case 29 includes a circumferential groove 33 and a circumferential platform 34. The top ring 26 is an assembly of a ring carrier 35 and a ring bezel 36 held thereon by a bendable tab 36*a*.

Ring carrier 35 includes an inwardly facing circumferential groove 37 facing case groove 33. An undulating circumferential spring 38 serves to hold the ring carrier 35 on case 29 and to provide a downward pressure toward crowns 27, 28 and keeping the ring carrier 35 against platform 34. The knurling 26*a* for manually turning top ring 26 is shown as corrugations in the outer wall of bezel ring 36, but could also be molded into the outer wall of ring carrier 35. The ring carrier 35 is preferably constructed of plastic such as Delrin™ and is molded to include a first set of teeth 39, having a gear tooth profile preferably of an involute shape. The crown 27 is provided with a second set of mating teeth 40, also of involute profile. Teeth 40 may be optionally bifurcated by a circumferential groove 41 for assistance in grasping the crown to move it axially away from the watch case.

FIG. 5 is an end view of the crown 28. As opposed to crowns in the prior art, which have small corrugated grooving, forming "teeth", or knurling, for assistance in rotating the crown, crown 28 has actual gear teeth 40 of an involute profile carefully machined in accordance with well known gear technology such as hobbing, and designed to provide the best transfer of force from the involute teeth on the ring carrier 35 to the involute teeth on the crown 28.

If desired, ring carrier 35 may also be provided with an indexing or detenting feature by constructions well known in the art to cause it to move circumferentially in steps, as well as to hold it against inadvertent rotation.

Crown 27 in FIG. 3 is constructed in the same manner with involute gear teeth on its periphery which are also meshing with the set of teeth 39 on ring carrier 35. However, crown 27 is not engaged in the inner position, but may be engaged for fast date setting in the second axial position 27' or for time setting in the third axial position 27".

OPERATION

Referring to FIG. 3 of the drawing, the setting of the alarm setting crown 28 may be operated in the following manner. In its innermost position 28, the inner stem connected to crown 28 (not shown) is arranged to be electrically inactive, but to be engaged with the alarm setting mechanism to set the alarm and timer rings, while it is further arranged to be both mechanically inactive and electrically active to activate the alarm and timer functions respectively in the second and third axial positions 28', 28" respectively. By this means, the crown 28 may be rotated when top ring 26 is turned without affecting alarm or timer setting, but may be pushed into an engaged position and rotated by top ring 26 to set either the alarm or timer as desired. A vast improvement in operation results, for two reasons. First, the relatively large circumference of the top ring 26 makes it easy to grasp and turn by the knurled surface 26*a*. Secondly, the gear ratio between the first and second set of gear teeth causes the crown 28 to make many more revolutions than the top ring 26, so that fewer revolutions are required to rotate the hands of the timepiece, speeding up the setting process.

Referring to FIG. 3 of the drawing, another setting stem (not shown) in its inner position 27, is rotatable in a first axial position, but is not engaged with a settable gear train in the movement. When withdrawn to a second axial position 27', stem 18 is engaged with a fast date setting gear train in the movement. When withdrawn to a third axial position 27", stem 18 is engaged with a time setting gear train in the movement. Rather than manually rotating crown 27 directly with the fingers as in the prior art, top ring 26 is manually rotated, and the first set of gear teeth 39 rotate crown 27 by a second set of meshing gear teeth similar to gear teeth 40 shown in FIG. 5.

MODIFICATION

Figure 6:
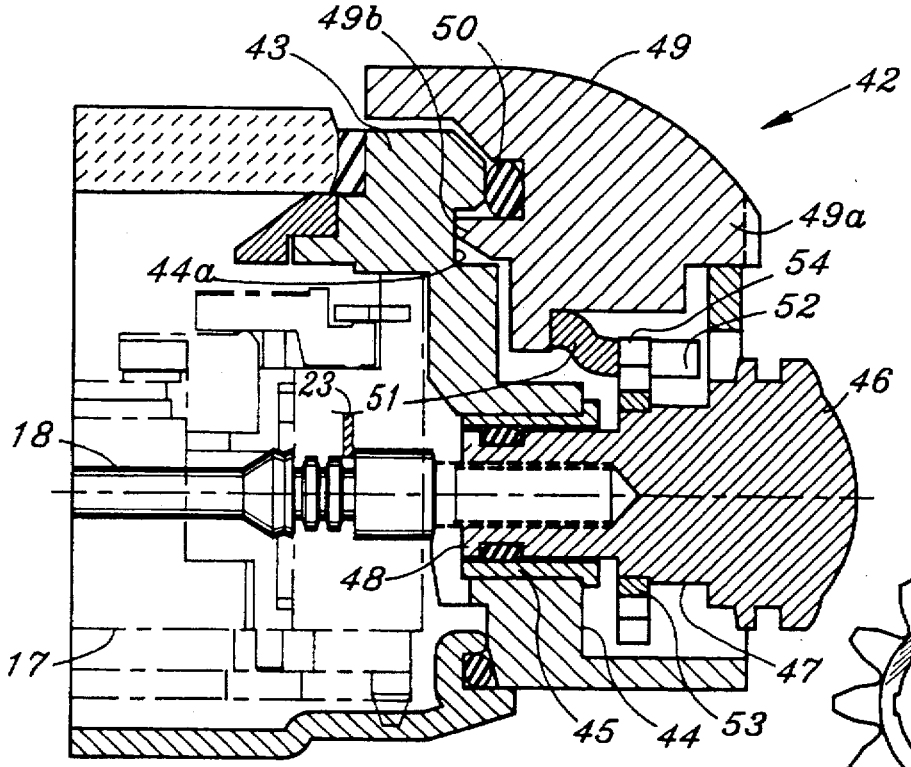
Figure 7:
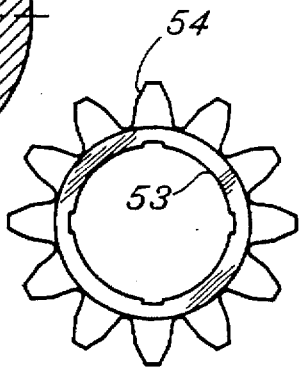

A modified form of the invention is shown in FIGS. 6 and 7. A wristwatch 42, a portion of which is shown in enlarged cross section in FIG. 6, includes a watch case 43 with a sidewall 44, through which passes a pendant 45. The movement 17, setting stem 18 and detenting spring 23 are as previously described. A crown 46 includes a first shank portion 47 and a second shank portion 48, the latter of which is rotatably and slidably mounted in pendant 45 and connected to stem 18 as before. A single piece rotatable top ring 49 with a circumferential knurling 49*a* is rotatably mounted on watch case 43. A circumferential groove 44*a* in case sidewall 44 receives a projecting portion 49*b* of top ring 49 with a snap fit to hold top ring 49 in place. An O-ring 50 provides a smooth friction of the ring 49.

In accordance with the present invention, a ring gear 51 preferably made as a steel stamping, is held by interference fit on the underside of top ring 49 and is provided with a first set of radially extending teeth 52. A second gear member 53 carrying a second set of teeth 54 is mounted on the shank 47 of crown 46. FIG. 7 is an end view of the second gear member 53 showing teeth 54 to be of an involute gear tooth profile designed to mesh properly with teeth 52. Since teeth 52 extend radially, crown 47 and the attached stem 18 may slide in an axial direction and still maintain engagement.

SECOND MODIFICATION

Figure 8:
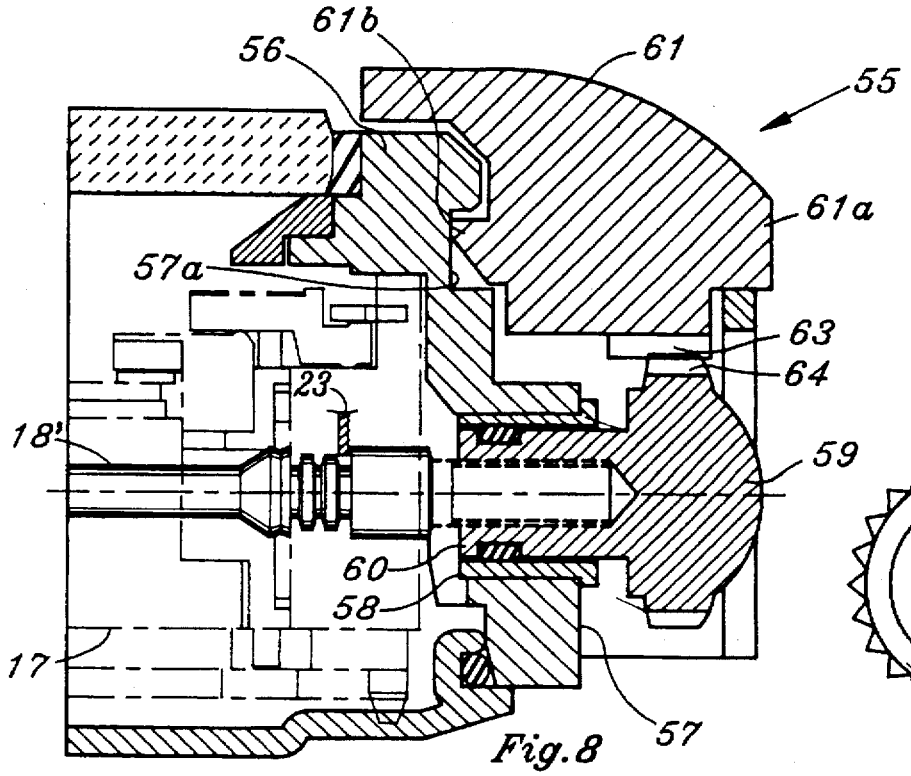
Figure 9:
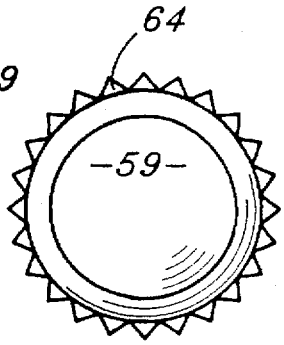

Reference to FIGS. 8 and 9 illustrates a second modification of the invention illustrated as used with a time setting crown rather than used for an alarm setting crown. A wristwatch 55 includes a watch case 56 with a sidewall 57, through which passes a pendant 58. The internal watch mechanism including movement 17, a time setting stem 18' and detenting spring 23 is substantially as previously described, except that the time setting stem 18' is mechanically disengaged in its innermost position, but is engaged with a settable gear means in its outermost position. A conventional watch crown 59 includes a shank 60 which is rotatably and slidably mounted within pendant 58, and is connected to the end of time setting stem 18'.

A top ring 61 with circumferential knurling 61*a* is rotatably mounted on case 56 in the same manner as previously described in FIG. 6, by means of a circumferential groove 57*a* in the sidewall of the watch case and held on by a projection 61*b* on the top ring. A first set of teeth 63 is cut into the underside of ring 61. Rather than using involute gear teeth, these may be simple corrugations, or grooves and ridges cut directly from a portion of the underside of ring 61.

FIG. 9 is an end view of crown 59, which contains a second set of teeth 64. Rather than being gear teeth, however, these are the conventional type of corrugated knurling or simple straight side tooth shape found on a conventional crown, rather than specifically designed as an involute gear tooth shape. The constructions of FIGS. 8 and 9 may be used in less expensive watches but illustrate the basic principle of the invention in simple form, used for a time setting crown.

While there has been described what is considered to be the preferred embodiment of the invention, other modifications will occur to those skilled in the art, and it is desired to secure in the appended claims all such modifications as fall within the true spirit and scope of the invention.

We claim:

1. Improved crown setting device for an analog timepiece having a case with a sidewall, a movement having settable gear means disposed inside said case, a setting stem rotatably mounted in the case sidewall in a first axial position, the setting stem being axially slidable to engage said settable gear means to perform a setting function when the setting stem is rotated in a second axial position, said crown setting device comprising:

a crown connected to said setting stem and having surface portions accessible outside of the case for enabling manual actuation in either axial direction between the first and second positions, a top ring rotatably mounted on said case and adapted to be manually rotated, first means including a first set of teeth disposed on the underside of said top ring, wherein said first means comprises a carrier ring having teeth formed in the underside thereof, and said top ring comprises a bezel ring attached to said carrier ring, and second means including a second set of teeth disposed on said crown, said second set of teeth meshing with said first set of teeth in both the first and second axial positions.

2. The crown setting device of claim 1, wherein said carrier ring is of plastic material and the teeth are molded in the underside thereof.

3. The crown setting device according to claim 1 and further including a spring adapted to bias said carrier ring and said first means toward the second set of teeth.

4. The crown setting device according to claim 1, wherein said first set and second set of teeth have gear tooth profiles.

5. The combination according to claim 4, wherein the gear tooth profiles are involute shape.

6. The combination according to claim 4, wherein the gear tooth profiles are cycloid shape.

7. The combination according to claim 4, wherein the gear tooth profiles are of an interchangeable standard spur gear shape.

8. The crown setting device according to claim 1, and further including a spring arranged to bias said top ring and said first means toward said second set of teeth.

9. The combination according to claim 8, wherein said gear tooth profiles are substantially of an involute shape.

10. The crown setting device according to claim 1, wherein said first means comprises a ring gear having radial teeth and attached to the underside of the top ring, and wherein said crown includes a shank, and wherein said second means comprises a second gear member having gear teeth and disposed on said shank.

11. The crown setting device according to claim 1, wherein the first means comprises simple corrugations formed in the underside of the top ring, and wherein the second means comprises conventional simple ridges and grooves on the crown exterior forming said second set of teeth.

12. Improved crown setting device for an analog alarm calendar timepiece with watch hands, date ring and alarm setting rings and having a case with a sidewall, a movement having first settable gear means connected to the watch hands, second settable gear means connected to the date ring, and third settable gear means connected to the alarm setting rings disposed inside said case, a time setting stem rotatably mounted in the case sidewall in a first axial position, the time setting stem being axially slidable to engage said first settable gear means to perform a fast date setting function when the setting stem is rotated in a second axial position, and engageable with the second settable gear means to perform a time setting function when the setting stem is rotated in a third axial position, a time setting crown connected to said time setting stem and having surface portions accessible outside of the case for enabling manual actuation in either axial direction between the first, second, and third positions, an alarm setting stem rotatably mounted in the case sidewall in a first axial position to engage the third settable gear means to perform an alarm or timer setting function, the alarm setting stem being axially slidable to disengage from the third settable gear means to electrically activate the alarm function when the alarm setting stem is pulled in a second axial position and to electrically activate the timer function when the alarm setting stem is pulled in a third axial position, and an alarm setting crown connected to said alarm setting stem and having surface portions accessible outside of the case for enabling manual actuation in either axial direction between the first, second and third positions, the crown setting device comprising:

a top ring rotatably mounted on said case and adapted to be manually rotated, first means including a first set of teeth disposed on the underside of said top ring, second means including a second set of teeth disposed on said time setting crown, said second set of teeth meshing with said first set of teeth in the first, second and third axial positions, and third means including a third set of teeth disposed on said alarm setting crown, said third set of teeth meshing with said first set of teeth in the first, second and third axial positions.

13. The crown setting device according to claim 12, wherein said first means comprises a carrier ring having teeth formed in the underside thereof, and said top ring comprises a bezel ring attached to said carrier ring.

14. The crown setting device of claim 12, wherein said carrier ring is of plastic material and the teeth are molded in the underside thereof.

15. The crown setting device according to claim 14 and further including a spring adapted to bias said carrier ring and said first means toward the second and third sets of teeth.

16. The crown setting device according to claim 12, wherein said first, second and third sets of teeth have gear tooth profiles.

17. The combination according to claim 16, wherein the gear tooth profiles are involute shape.

* * * * *